US009909416B1

(12) United States Patent
Sollami

(10) Patent No.: US 9,909,416 B1
(45) Date of Patent: Mar. 6, 2018

(54) DIAMOND TIPPED UNITARY HOLDER/BIT

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 263 days.

(21) Appl. No.: 14/487,493

(22) Filed: Sep. 16, 2014

Related U.S. Application Data

(60) Provisional application No. 61/879,353, filed on Sep. 18, 2013.

(51) Int. Cl.
*E21C 35/18* (2006.01)
*E21B 7/00* (2006.01)

(52) U.S. Cl.
CPC ..... *E21C 35/18* (2013.01); *E21B 7/00* (2013.01); *E21C 2035/1803* (2013.01)

(58) Field of Classification Search
CPC ..... E21C 35/18; E21C 2035/1803; E21C 2035/1813; E21B 10/573
See application file for complete search history.

(56) References Cited

U.S. PATENT DOCUMENTS 3,397,012 A 8/1968 Krekeler
3,519,309 A 7/1970 Engle
3,865,437 A 2/1975 Crosby
4,084,856 A 4/1978 Emmerich
4,310,939 A 1/1982 Iijima
4,453,775 A 6/1984 Clemmow
4,478,298 A * 10/1984 Hake ..... E21B 10/573 175/432
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,694,918 A 9/1987 Hall
4,811,801 A 3/1989 Salesky
4,818,027 A 4/1989 Simon
4,844,550 A 7/1989 Beebe
4,525,178 B1 3/1990 Hall
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
(Continued)

FOREIGN PATENT DOCUMENTS

DE 102011079115 1/2013
DE 102015121953 7/2016
(Continued)

*Primary Examiner* — John J Kreck
(74) *Attorney, Agent, or Firm* — James N. Videbeck; Mercedes V. O'Connor; Rockman Videbeck & O'Connor

(57) ABSTRACT

A unitary bit/holder assembly includes a reverse taper insert having a diamond coated tip mounted thereon that is received in an annular flange forwardmost portion of a holder body. In a modification, the diamond coated tip is received in a recess on a generally cylindrical forwardmost portion of the holder body.

12 Claims, 6 Drawing Sheets

(56) References Cited

U.S. PATENT DOCUMENTS 5,287,937 A 2/1994 Sollami
5,302,005 A 4/1994 O'Neill
5,303,984 A 4/1994 Ojanen
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,492,188 A * 2/1996 Smith ..... B23B 27/145 175/432
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 6/2001 Sollami
6,331,035 B1 12/2001 Montgomery, Jr.
6,357,832 B1 3/2002 Sollami
6,371,567 B1 4/2002 Sollami
6,508,516 B1 1/2003 Kammerer
D471,211 S 3/2003 Sollami
6,584,810 B2 7/2003 Montgomery
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 * 12/2008 Hall ..... E21C 35/183 299/111
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 * 12/2009 Hall ..... A47C 3/00 299/104
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhammer
9,039,099 B2 5/2015 Sollami
9,316,061 B2 4/2016 Hall
2002/0074850 A1 6/2002 Montgomery
2002/0074851 A1 6/2002 Montgomery
2002/0167216 A1 11/2002 Sollami
2003/0015907 A1 1/2003 Sollami
2004/0004389 A1 1/2004 Latham
2006/0071538 A1 4/2006 Sollami
2006/0186724 A1 8/2006 Stehney
2009/0200857 A1 8/2009 Hall
2009/0261646 A1 10/2009 Ritchie et al.
2010/0244545 A1 9/2010 Hall
2010/0253130 A1 10/2010 Sollami
2011/0006588 A1 1/2011 Monyak et al.
2011/0089747 A1 4/2011 Helsel
2011/0204703 A1 8/2011 Sollami
2011/0254350 A1 10/2011 Hall
2012/0027514 A1 2/2012 Hall
2012/0038203 A1 2/2012 Hall
2012/0068527 A1 3/2012 Erdmann
2012/0181845 A1 7/2012 Sollami
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2014/0326516 A1 * 11/2014 Haugvaldstad ..... E21B 10/567 175/366
2015/0028656 A1 1/2015 Sollami
2015/0240634 A1 8/2015 Sollami
2015/0285074 A1 10/2015 Sollami
2015/0292325 A1 10/2015 Sollami
2015/0300166 A1 10/2015 Ries et al.

(56) References Cited

U.S. PATENT DOCUMENTS

| | | | |
|---|---|---|---|
| 2015/0315910 | A1 | 11/2015 | Sollami |
| 2015/0354285 | A1 | 12/2015 | Hall |
| 2016/0194956 | A1 | 7/2016 | Sollami |
| 2017/0089198 | A1 | 3/2017 | Sollami |

FOREIGN PATENT DOCUMENTS

| | | | |
|---|---|---|---|
| DE | 102016118658 | | 3/2017 |
| GB | 2483157 | | 2/2012 |
| WO | 2008105915 | A2 | 9/2008 |
| WO | 2008105915 | A3 | 9/2008 |
| WO | 2009006612 | | 1/2009 |

* cited by examiner

DIAMOND TIPPED UNITARY HOLDER/BIT

This invention claims priority of provisional application Ser. No. 61/879,353 filed Sep. 18, 2013.

This invention relates to combination bit/holders used in road milling, mining and trenching and, more particularly, to diamond coated tungsten carbide inserts and structure for mounting them as part of a unitary bit/holder combination.

BACKGROUND OF THE INVENTION

Road milling bits and bit holders, the design of which, when made in differing sizes, can also be used for trenching machines and mining machines, have benefitted greatly from what has been termed a quick change shank, found in the instant inventor's prior U.S. Pat. Nos. 6,371,567; 6,685,273 and 7,883,155. Additionally, the construction features of the forward end of the advanced bit design found in applicant's U.S. Pat. No. 6,739,327 has been cited in over 70 later issued patents. The Burkett U.S. Pat. No. 5,161,627 disclosed that one could mount a diamond coated insert in a one-piece bit/bit holder body. A similar structure with a diamond coated tip is found at the Sionett U.S. Pat. No. 4,944,559. These diamond coatings have heretofore been formed in a standard process that includes high temperature, high pressure forming of same on a tungsten carbide high impact substrate.

A later version of the present applicant's prior invention of a quick change shank such as found in the U.S. Pat. No. 6,371,567 patent is provided in combination with a diamond tip and found at the Hall et al U.S. Pat. No. 8,118,371.

With diamond coated tips of road milling machinery, it has been found that the working life of the tip has been greatly increased. As such, it is no longer necessary to provide changeable bits in bit holders. The operating life of bits and bit holders are such that they can be physically combined in a unitary structure.

A need has developed for a lower cost combination diamond coated tip and front portion, formerly used on a removable bit, with a quick change bit holder.

SUMMARY OF THE INVENTION

The invention is found in a tip assembly for an attack tool comprising a diamond coated tungsten carbide tip, a tungsten carbide insert, and a steel transition pad positioned between said tip and said insert.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

Figures 6, 6A, 6B:
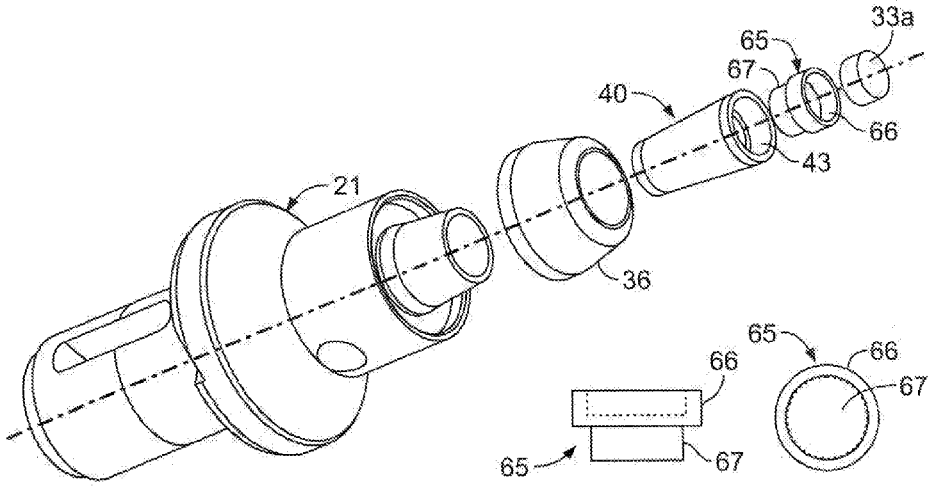
FIG. 6 is an exploded perspective view of a modification of the combination bit/holder shown in FIGS. 1-5 further including an added steel cup into which the tungsten carbide diamond coated tip is inserted which, in turn is inserted in the forward end of the reverse taper tungsten carbide insert.
Figures 7, 8:
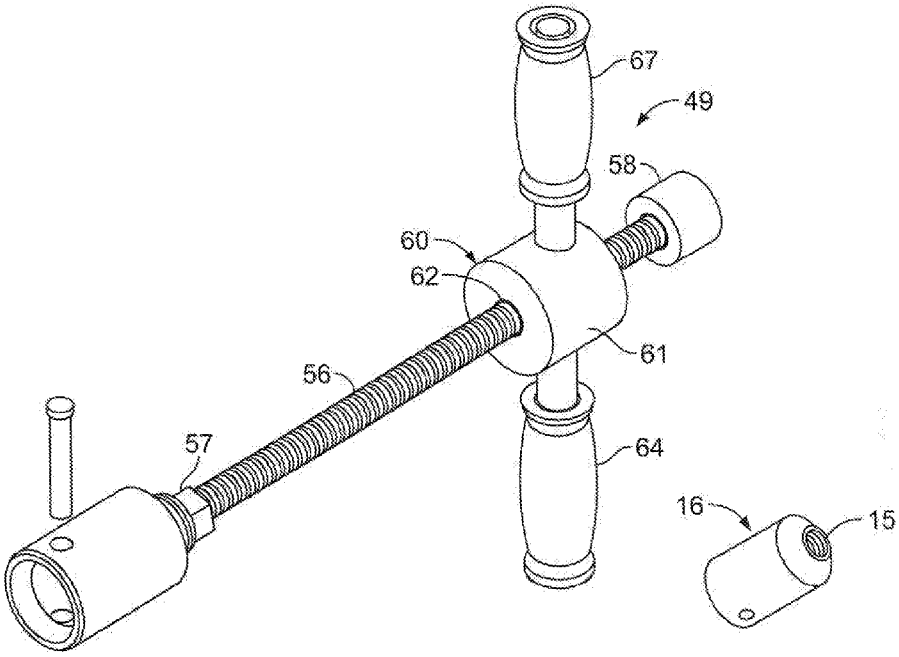
Figure 9:
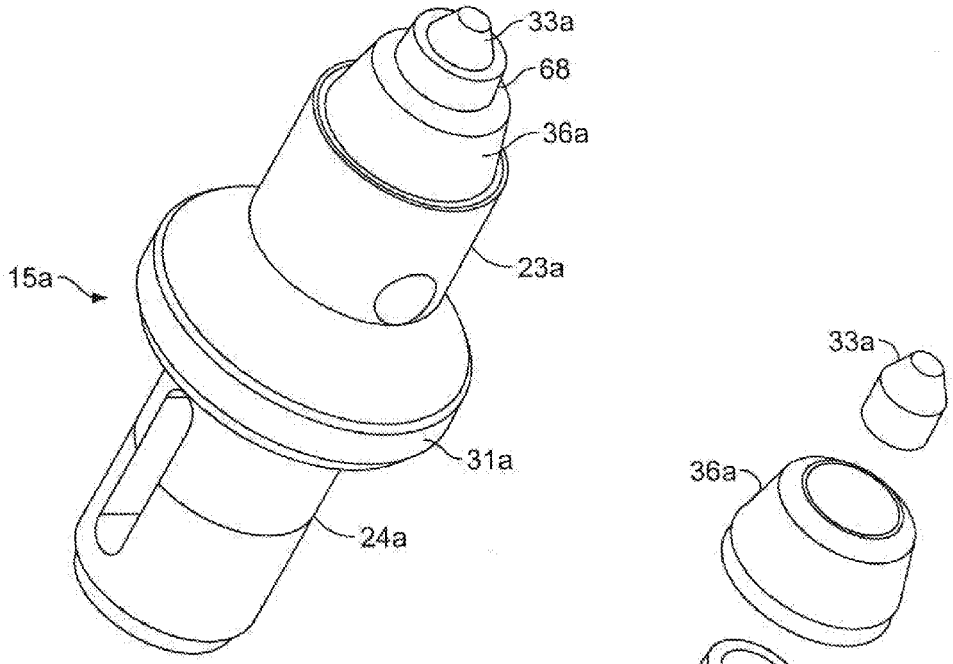
Figure 10:
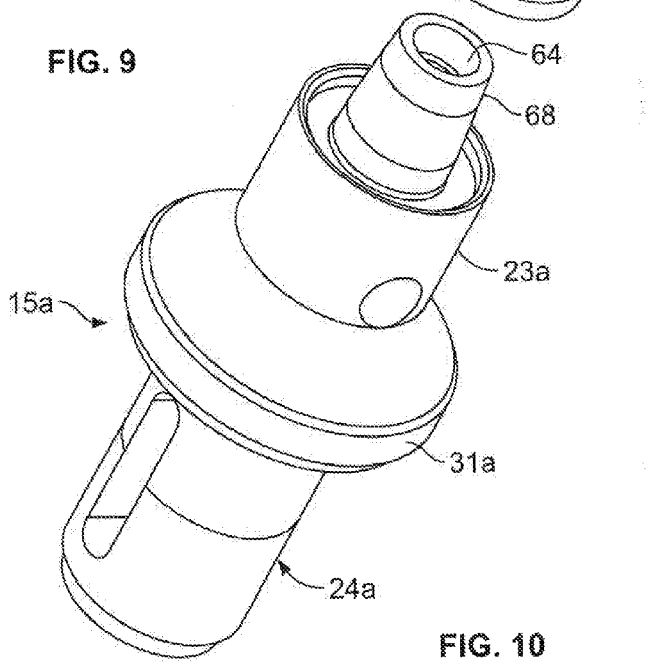

FIG. **6*a* is an elevational view of the tip receiving cup including the bottom pad shown in FIG. 6**;

FIG. **6*b* is a top plan view of the cup shown in FIG. 6**;

FIG. 7 is a top ¼ perspective view of a complete bit/holder removal tool for removing the bit/holder from a bit block;

FIG. 8 is a top ¾ perspective view of the female cup of the bit/holder removal tool showing the Acme threaded top bore therein;

FIG. 9 is a top ¼ perspective view of a second modification of the bit/holder incorporating an annular steel front end of the bit holder adapted to receive the tungsten carbide diamond coated tip insert therein; and FIG. 10 is an exploded view of the bit/holder shown in FIG. 9 with the annular tungsten carbide ring exploded out of its annular pocket more clearly showing the steel front end of the bit holder of FIG. 9 adapted to receive the tungsten carbide diamond coated insert therein to provide added ductility and shock absorption to the assembly.

Figure 11:
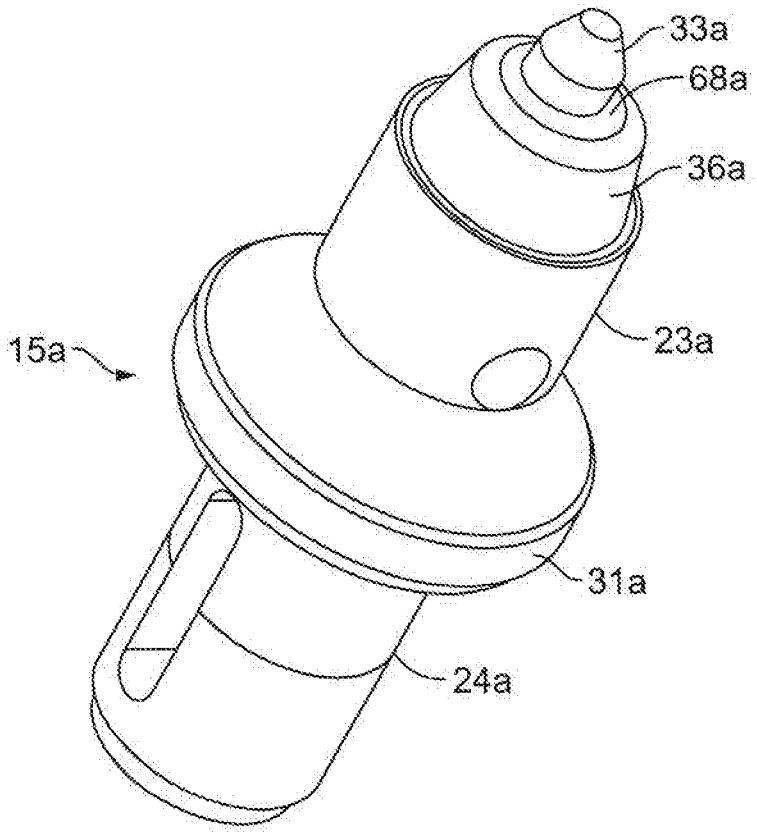

FIG. 11 is a top ¾ perspective of the second modification shown in FIG. 9 as it appears when the bit/holder has been in use a short time with an upper distal annular end worn away.

DETAILED DESCRIPTION OF THE PREFERRED EMBODIMENTS

Figure 1:
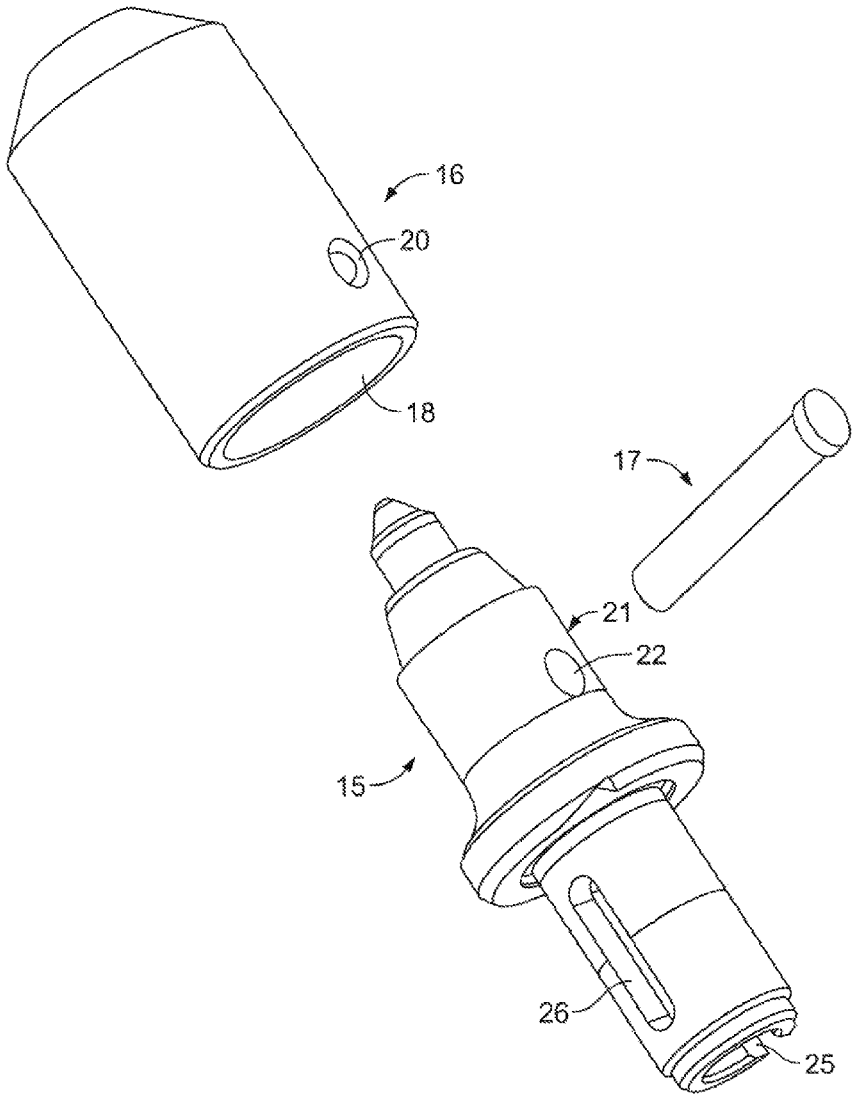
FIG. 1 is an exploded perspective view of the combination diamond coated bit/bit holder constructed in accordance with the present invention together with a drift pin and cup portion of a tool useful for inserting the bit holder in its bit block (not shown)

Referring to FIG. 1, a combined diamond coated bit/holder is shown, generally at 15, in its completed form together with a female cup insertion member 16 and its accompanying drift pin 17, which extends through the hollow open bottom 18 of the female cup member through aperture 20 and through a body 21 of the combined bit/holder at bore 22 for insertion into a bit block (not shown) which, in turn, is mounted on a rotatable drum (not shown).

Figure 2:
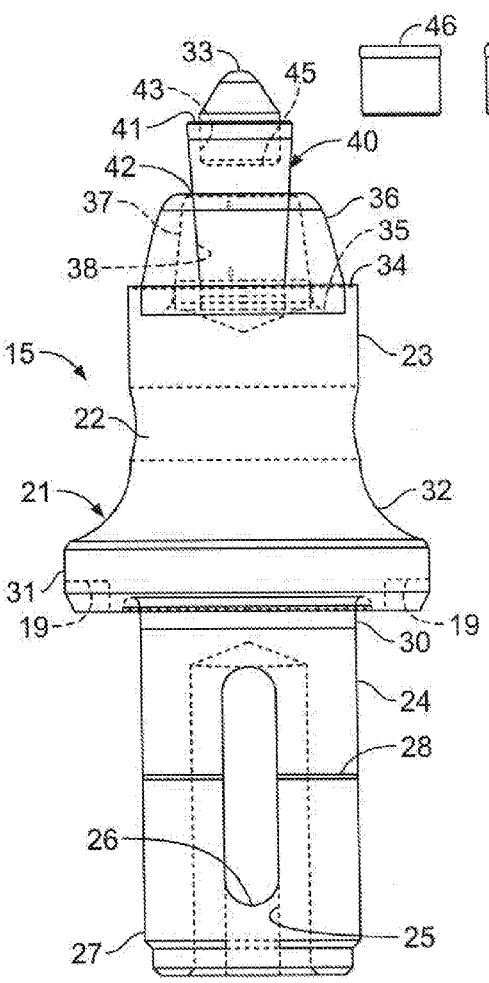
FIG. 2 is a front elevational view of the combination diamond coated tip bit/bit holder of the present invention shown in FIG. 1 together with two alternate shape diamond coated tip inserts.
Figure 3:
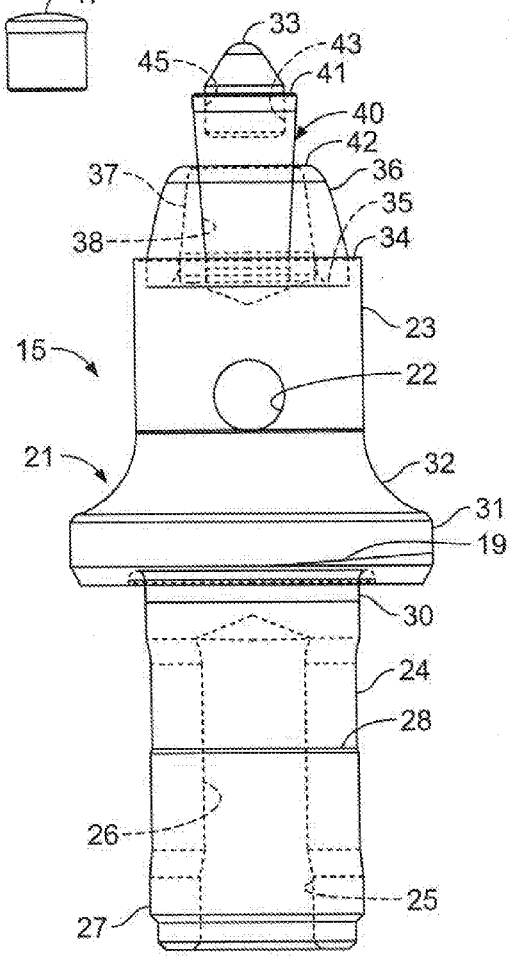
FIG. 3 is a side elevational view of the combination diamond coated tip/bit holder shown in FIG. 2.

Referring to FIGS. 1-3, a first embodiment of the combination diamond coated bit/holder 15 includes a holder base 21 having an upper body portion 23 and a lower shank portion 24. The upper and lower shank portion are both made of 4140, 4340, or similar steel. The lower shank portion 24 is a hollow, generally cylindrical member having at least one slot 25 extending axially through the side of the hollow shank from the distal end upwardly toward the top of the shank portion. Alternately, a second, wholly internal slot 26, may be positioned preferably 180 degrees around the shank from the first slot extending in an axial direction similar to the first slot 25, however, starting from a position in spatial relation upwardly from the bottom distal end of the shank as shown at 26 in FIG. 2.

In the preferred embodiment 15, the shank 24 includes a lower resilient bit block bore engaging portion 27, and a millable shank portion 28 which may in this embodiment be a few thousandths of an inch. An uppermost part of the shank 30 immediately adjacent the larger body portion 21 includes a generally cylindrical portion having an annular outer surface sized to be press fit into the top of the bit block bore (not shown). As noted previously in U.S. Pat. Nos. 7,883,155, 6,685,273 and 6,371,567, the interference fit between the bottom shank portion 27 and a bit holder bore is substantially larger than a standard interference fit (0.001-0.003) for a solid shank, extending approximately 0.012 to 0.030 inches for a nominal 1½ inch diameter shank for use in road milling.

The upper or body portion 21 of the holder 15 includes a radially extending annular flange 31 defining the bottom of what is termed in the industry as a tire portion, diametrically the widest segment of a holder (about 2⅝ inch for a road milling holder). The height of the tire portion may approximate ½ inch and includes a pair of opposing wedge shape cutouts 19-19. From the top of the tire portion, the body generally slopes radially inwardly at 32 and upwardly to perform a ramp-like function with the aim of moving material, macadam, concrete, etc. outwardly from the forward tip of the diamond covered leading portion 33 of the bit/holder. In this preferred embodiment, the mid section of the upper body portion of the holder 23 includes a generally cylindrical segment having at the bottom thereof a cross or through hole 22 substantially perpendicular to the longitudinal axis of the holder. This cross hole 22 extends horizontally through the body portion and forms a receiver for a drift pin 17, shown most clearly in FIG. 1 used in connection with the cup portion of a bit/holder insertion tool 16, a part of which is also shown in FIG. 1, and which will be discussed in more detail below.

This upper cylindrical segment 23 of the preferred holder body 21 is, with the exception of the through hole 22 mentioned previously, generally solid and provides a substantial portion adding bulk and toughness to the combination bit/holder 15. As shown most clearly in FIGS. 2 and 3, the upper surface 34 of the holder is also made of the same steel as the remainder of the holder and includes an annular trough 35 in which an annular tungsten carbide sleeve 36 is positioned and brazed in place. The trough provides a retainer for an annular braze disk (not shown) which when melted adheres the base of the annular tungsten carbide ring 36 to the trough bottom. Radially inwardly of the tungsten carbide ring is an annular steel axially extending flange 37 that includes a central tapered cutout portion 38. A reverse taper tungsten carbide insert 40 is fitted into that tapered bore 38 and brazed therein. The top 41 of the tungsten carbide insert 40 extends substantially beyond the top 42 of the steel annular ring 37 and with the exception of a generally cylindrical recess 43 in the top surface thereof is constructed substantially similar to the cutting tool bit shown and disclosed in the present inventor's issued U.S. Pat. No. 6,739,327. The tungsten carbide reverse taper insert 40 provides a toughened insert for holding a commercially available diamond coated tip 44 which has a generally cylindrical tungsten carbide base 45 and a diamond coated tip which may be conical 33, flat 46 or oval 47 in cross section as shown in FIG. 2. Similarly to the tungsten carbide members previously mentioned, the base 45 of the tip insert 33 is brazed into the tungsten carbide reverse tapered insert member 40.

It should be noted that during assembly, only the top part of the bit body 23 is heated by a inductance coil surrounding same to a temperature just slightly over the melting point of the brazing discs used, i.e., about 1300 degrees F. The careful positioning of the inductance coils provides for heating a minimal area of the upper portion 21 of the bit/holder 15, thus minimally affecting the grain structure, hardness, toughness etc. of the holder itself.

Figure 4:
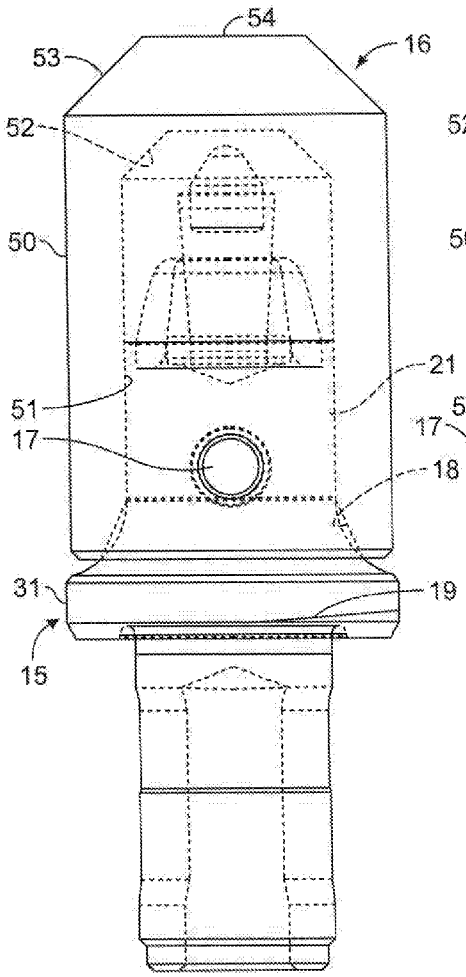
FIG. 4 is a side elevational view of the combination diamond coated bit/bit holder shown in FIG. 3 with a cross section of the female end of the holder insertion tool of FIG. 1 shown as mounted over the forward end of the bit/holder.
Figure 5:
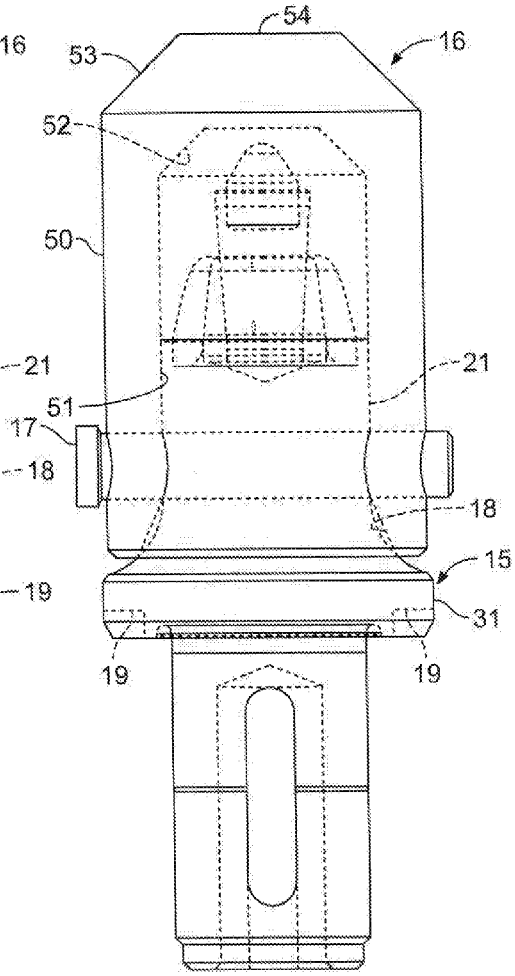
FIG. 5 is a front elevational view of the bit/holder shown in FIG. 4 with a cross section of the female end of the bit/holder insertion tool shown in FIG. 4 having the drift pin positioned through both the removal tool and the combination bit/holder.

Referring to FIGS. 4 and 5, the combination diamond tip bit/holder 15 shown in FIGS. 4 and 5 is exactly the same as that described in FIGS. 1-3. What is shown in FIGS. 4 and 5 is the mounting of the female or cup shape bit portion 16 of a bit insertion/removal tool, generally at 49, (FIG. 7) as it appears mounted on the top or holder body 21 of the combination bit/holder 15 together with the drift pin 17 positioned through the central portion 21 of the holder body and the outer annular wall of the cup or female insertion member 16.

As shown in FIGS. 1, 4 and 5, the female member 16 is generally cup shaped, having an outer cylindrical wall 50 and an inner, generally cylindrical bore 51 or hollow portion sized to rather loosely fit over the outside of the top 21 of the holder body 15 with a generally flared distal portion 18 sized to fit over the sloped segment 32 of the bottom of the holder body upwardly adjacent the tire portion thereof.

A bore 20-20 horizontally through the walls of the female cup member 16 is sized and positioned to align with the through or cross bore 22 in the holder body 16 to allow a drift pin 17 to be loosely positioned therethrough. The upper hollow or bored out portion of the cup member body fits over the diamond coated bit 33, tungsten carbide insert 40, and the tungsten annular ring 36 at the recess 35 in the top wall 34 of the holder body 21. The upper portion of the cup is, in this embodiment, tapered to a frustoconical shape 53 having a generally flat upper surface 54.

Referring to FIGS. 7 and 8, the female or cup portion 16, as mentioned previously, includes an upper threaded bore 55 centrally therethrough which is adapted to receive an Acme threaded rod 56 therein as a part of a bit insertion/removal tool 50. In order to maintain the cup 16 on the Acme threaded rod 56, a nut 57 is threaded on the rod and tightened against the upper annular wall of the cupped member 16 to secure same thereon. The Acme threaded rod 56 extends from the female cup member 16 to a distal stop 58 on the opposite end of the Acme threaded rod. In between is slidably mounted a dual handle hammer member 60 having a central annular portion 61 with a central bore 62 therethrough slightly larger than the outer dimension of the Acme thread for sliding along the threaded rod 56. 180 degrees apart on opposite sides of the annular central member are mounted hand holds 63-64 perpendicularly to the bore through the central member 61, each having a form fitting grip on its distal end. In operation, once the female cup member 16 is fitted over the top 21 of the bit/holder 15 and the drift pin 17 positioned therethrough, the double hand hold slider 60 may be quickly moved axially along the Acme threaded rod 56 and rammed onto the stop 58 at the distal end thereof to provide axial hammer type outward force to enable the removal of the bit holder 15 from its respective bit block bore (not shown).

Referring to FIGS. 6, **6*a* and 6*b*, a first modification of the diamond coated bit/holder 15 of the present invention shown in FIGS. 1-5 is substantially identical to the holder 21, tungsten carbide ring 36, and tip 33 of that embodiment. The only difference being the mounting of a steel receiving cup 65 being about ⅜-1 inch, in height, that is brazed into the forward recess 43 of the reverse taper insert 40**.

The diamond coated tip 33, **33*a*, 46 and 47 is brazed into the hollow cup forward portion 66 of the steel cup insert 65. The reasoning behind the addition of the cup shaped thick bottom 67 of the steel insert 65 relates to the ductility of the steel vs. the non-ductility of the tungsten carbide insert 40. The use of a solid bottomed 67 steel cup 65 member allows the ductility of that thick cylindrical bottom pad to cushion the repeated hammer blows received at the diamond coated tip 33***a*. This added ductility to the tip end 33*a* of the bit allows that bit/holder 15 to be used not only in removing MacAdam, but also in removing a concrete and other hardened and non-homogenous materials, thus giving added life and a widened field of use for the bit/holder combination 15 over previously known diamond coated bits. Further, the tungsten carbide to steel to tungsten carbide sequence of the disclosed modification yields substantially stronger bonds than brazing tungsten carbide to tungsten carbide.

Referring to FIGS. 9 and 10, a second modification 15*a* of the present invention is generally shown. As with the previous modification, the portion of the holder including the shank 24*a*, tire portion 31*a*, mid and most of the upper body portion 23*a* of the holder 15*a* are identical to that shown in the first embodiment. However, the axially extending upper annular flange 68 of the holder 15*a* immediately inwardly adjacent the tungsten carbide protective ring 36*a* is substantially solid with the exception of a generally cylindrical recess 64 sized for the fitting of the diamond covered commercial insert 33*a* which may be brazed therein. This modification of the uppermost portion of the holder body provides a substantial steel mounting for the diamond coated tungsten carbide body tip 33*a*. This substantial steel upper portion 68 provides added ductility, even more so than the steel thick bottomed cup 65 shown in FIG. 6. This increased ductility acts as a shock absorber for the diamond coated tungsten carbide tip 33, 33*a*, 46 and 47 enabling same to the used in more than just the asphalt or macadam removal, which was a limitation to the use of previously known diamond coated bit tips in road milling. Additionally, the steel to tungsten carbide braze joint between the tip and the holder body is stronger than a tungsten carbide to tungsten carbide braze joint.

Referring to FIG. 11, the bit/holder 15*a* shown in FIGS. 9 and 10 is shown as it appears after use in the field has started. In use, the bit/holder 15*a* wears adjacent its tip insert 33*a*. The steel annular ring 68 which forms the top of the upper body 23*a* of the bit/holder wears away quickly during use, as shown at 68*a* in FIG. 11, somewhat similarly to upper portion 66 of cup 65 shown in FIGS. 6, 6*a* and 6*b*, to the extent where it generally coincides with the top surface of the tungsten carbide annular ring 36*a* after use.

The purpose of the extended initial portion of the steel annular ring 68 shown in FIGS. 9 and 10 is to seat the diamond tipped insert 33*a* in its recess 69 as shown in FIG. 10. Initially, the tungsten carbide annular ring 36*a* is seated in its recess at the top of the body portion 23*a* with a ring of brazing material between that recess and the bottom of the annular ring 36*a*. A combination of the holder and tungsten carbide annular ring are heated to between 1,650-2,000 degrees F. in the first operation to join those parts of the bit holder together into a unitary structure. The tungsten carbide ring and holder are quenched and tempered to a hardness of RC 40-48, in a separate heat treatment process.

Next, the PCD or diamond insert 33*a* is positioned in recess 69 preferably over a silver brazing disc (not shown). This combination is then heated between 1,000-1,300 degrees F. by an induction heater (not shown) which encircles the upper tip portion of the bit holder 15*a*. The flow of heat through the annular steel ring 68 more effectively magnetically couples to the iron in the steel in the ring 68 to transfer heat to the tungsten carbide. The heat more efficiently goes through the steel to melt the flux and braze material between the insert 33*a* and the recess 69 of the steel ring 68. These two processes that join both the tungsten carbide annular ring 36*a* and the diamond tip insert 33*a* to the upper body 23*a* and recess 69 of the inner annular ring 68 are made at two differing temperatures to provide a more stable unitary structure in the end-finished bit holder of the present invention.

While one embodiment and two additional modifications of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A tip assembly for an attack tool comprising:
an HTHP tip including a substrate and a diamond coating on top thereof,
a tungsten carbide insert, and
a steel pad positioned between said tip and said insert.

2. The tip assembly as defined in claim 1 wherein:
a bottom of said tip is brazed to a top of said pad, and
a bottom of said pad is brazed on said tungsten carbide insert.

3. The tip assembly as defined in claim 1 wherein:
said steel pad between said tip and said insert acts as a shock absorber for said assembly.

4. The tip assembly as defined in claim 1 wherein:
said pad includes an axially extending annular rim therearound for retaining braze material between said substrate and said pad.

5. The tip assembly as defined in claim 4 wherein an inner diameter of said annular rim is at least as large as an outer diameter of said pad.

6. The tip assembly as defined in claim 1 wherein said insert includes a hollow cylindrical bore in a top thereof in which said pad is received.

7. The tip assembly as defined in claim 1 wherein said pad covers an entire bottom of said tip.

8. The tip assembly as defined in claim 1 wherein a substantial portion of a bottom of said tip substrate is tungsten carbide.

9. A tip assembly for an attack tool comprising:
a high temperature, high pressure formed tip including a substrate and a diamond coating on the top thereof;
a tungsten carbide insert having a recess on a top thereof; and
a steel pad positioned between said tip and said recess on said insert.

10. The tip assembly as defined in claim 9 wherein:
said steel pad includes a generally cylindrical base, and
an axially extending annular rim extending from a periphery of said pad, an inside diameter of said rim being at least as large as an outer diameter of said base.

11. The tip assembly as defined in claim 4 wherein said pad covers an entire bottom of said tip.

12. The tip assembly as defined in claim 4 wherein a substantial portion of a bottom of said tip substrate is tungsten carbide.

* * * * *